US009138609B2

(12) United States Patent
Placide

(10) Patent No.: US 9,138,609 B2
(45) Date of Patent: Sep. 22, 2015

(54) EXERCISE APPARATUS INCLUDING A DIP BAR

(71) Applicant: Abdon Placide, Jamaica, NY (US)

(72) Inventor: Abdon Placide, Jamaica, NY (US)

( * ) Notice: Subject to any disclaimer, the term of this patent is extended or adjusted under 35 U.S.C. 154(b) by 30 days.

(21) Appl. No.: 14/149,204

(22) Filed: Jan. 7, 2014

(65) Prior Publication Data

US 2014/0200123 A1 Jul. 17, 2014

Related U.S. Application Data

(60) Provisional application No. 61/753,222, filed on Jan. 16, 2013.

(51) Int. Cl.

| | |
|---|---|
| ***A63B 71/00*** | (2006.01) |
| ***A63B 21/068*** | (2006.01) |
| ***A63B 21/00*** | (2006.01) |
| ***A63B 23/12*** | (2006.01) |

(52) U.S. Cl.

CPC ..... *A63B 21/068* (2013.01); *A63B 21/00047* (2013.01); *A63B 21/1457* (2013.01); *A63B 23/1227* (2013.01); *A63B 23/1236* (2013.01); *A63B 2210/50* (2013.01)

(58) Field of Classification Search

CPC ..... A63B 21/00047; A63B 21/0005; A63B 21/00054; A63B 21/00185; A63B 21/0078; A63B 21/28; A63B 21/285; A63B 21/068; A63B 21/1457; A63B 23/121; A63B 23/218; A63B 23/1227; A63B 23/1236

USPC ..... 482/139; D6/681.1

See application file for complete search history.

(56) References Cited

U.S. PATENT DOCUMENTS

| | | | | |
|---|---|---|---|---|
| 3,695,609 | A * | 10/1972 | Rothe | 482/66 |
| 4,456,248 | A * | 6/1984 | Smith | 482/142 |
| 4,620,701 | A * | 11/1986 | Mojden | 482/41 |
| 5,096,187 | A * | 3/1992 | Marples | 482/41 |
| 5,261,868 | A * | 11/1993 | Pryor et al. | 482/142 |
| 5,316,527 | A * | 5/1994 | Lekhtman | 482/41 |
| 5,407,404 | A * | 4/1995 | Killian et al. | 482/38 |
| 6,248,048 | B1 * | 6/2001 | Zuckerman et al. | 482/142 |
| 7,918,770 | B1 * | 4/2011 | Hoole | 482/96 |
| 2009/0023566 | A1 * | 1/2009 | Florczak | 482/142 |

* cited by examiner

*Primary Examiner* — Loan H Thanh
*Assistant Examiner* — Nyca T Nguyen
(74) *Attorney, Agent, or Firm* — Ostrolenk Faber LLP

(57) ABSTRACT

An exercise apparatus that includes a plurality of dip bars arranged in a non-parallel orientation and supported on an elongated self-supporting stand, which is supported on a base. The self-supporting stand may include a plurality of elongated supports that are spaced from one another. The support and the dip bars may be arranged along first and second parallel planes that extend away from the self-supporting stand in the same direction.

10 Claims, 6 Drawing Sheets

EXERCISE APPARATUS INCLUDING A DIP BAR

CROSS REFERENCE TO RELATED APPLICATION

The present application claims priority to U.S. Provisional Patent Application No. 61/753,222, filed Jan. 16, 2013, the entire contents of which are incorporated in full herein by reference.

FIELD OF THE INVENTION

The present invention relates to exercise equipment and more preferably to an exercise apparatus that includes a dip bar.

BACKGROUND AND SUMMARY OF THE INVENTION

Dip bars are well known. A typical dip bar includes two parallel, spaced, and elongated tubes or the like bodies supported above ground. A well known exercise with a dip bar involves positioning oneself between the two dip bars, grabbing the dip bars each with one hand, supporting oneself above ground (i.e. feet off the ground), and alternately lowering and lifting oneself without touching the ground to exercise, for example, the chest muscles and the triceps.

Dip bars with non-parallel, spaced and elongated support tubes are also known.

The present invention relates to an exercise apparatus that includes dip bars integrated with and supported above ground on a self-supporting stand.

In one embodiment, the self supporting dip bar stand includes one continuous, preferably tubular, body extending from one dip bar support tube to another dip bar support tube. The continuous body may be configured to receive a back support so that it may be used as a bench in a different orientation.

In another embodiment, the apparatus may be configured so that it may be easily disassembled for storage.

An exercise apparatus according to the present invention includes a self-supporting stand supporting a plurality of dip bars arranged on a first common plane and oriented in non-parallel orientation relative to one another, the self-supporting stand being elongated and supported on a base.

The base may include a plurality of base supports arranged on a second common plane parallel to the first common plane, whereby the self-supporting stand is oriented vertically relative to the first common plane when the first common plane is oriented horizontally. The first and the second planes may extend away from the self-supporting stand in the same direction. A tie bar may be connected to respective ends of the base supports to define a continuous body extending from a free end of one the dip bars to a free end of another one of the dip bars. The tie bar may be disengageably coupled to the base supports.

According to one aspect of the present invention the exercise apparatus is configured so that the self-supporting stand is oriented horizontally when the first common plane and the second common plane are oriented vertically. A back support may be disengageably engaged with the self-supporting stand to define a bench.

In its preferred form, the self-supporting stand may include a plurality of spaced elongated supports. The back support may be coupled to the elongated supports to define a bench. The elongated supports may be parallel to one another.

In another embodiment, the apparatus includes a base section and a dip bar section, the dip bar section being disengageably engageable with the elongated supports and the base section being disengageably engageable with the elongated supports.

The dip bar section may include a dip bar section cradle that receives the elongated supports, and the base section may include a base section cradle that receives the elongated supports.

A first tie member may connect the first ends of the elongated supports, and a second tie member may connect the second ends of the elongated supports, the first tie member resting on the base section and the second tie member supporting the dip bar section.

The base section may be rotatable about the first tie member in a first direction to disengage from the elongated supports, and the dip bar section may be rotatable about the second tie member in a second direction opposite the first direction to disengage from the elongated supports. The first direction may be clockwise and the second direction may be counter-clockwise.

The base section cradle may include a portion that abuts the elongated supports when the base section is rotated in the second direction and the dip bar section cradle may include a portion that abuts the elongated supports when the dip bar section is rotated in the first direction.

The apparatus may further include a first elongated fold bar connected at one end to a tie member that connects the base supports and at another opposite end to the elongated supports, a second fold bar connected at one end to one of the dip bars and connected at another end to one of the elongated supports, and a third fold bar connected at one end to another one of the dip bars and at another end to another one of the elongated supports. The second fold bar may be disengageably connected at one end to one of the dip bars and pivotably connected at another end to one of the elongated supports, and the third fold bar may be disengageably connected at one end to another one of the dip bars and pivotably connected at another end to another one of the elongated supports. A snap fit connector may reside on the elongated supports for snap fit reception of the fold bars.

Other features and advantages of the present invention will become apparent from the following description of the invention, which refers to the accompanying drawings.

DETAILED DESCRIPTION

Figure 1A:
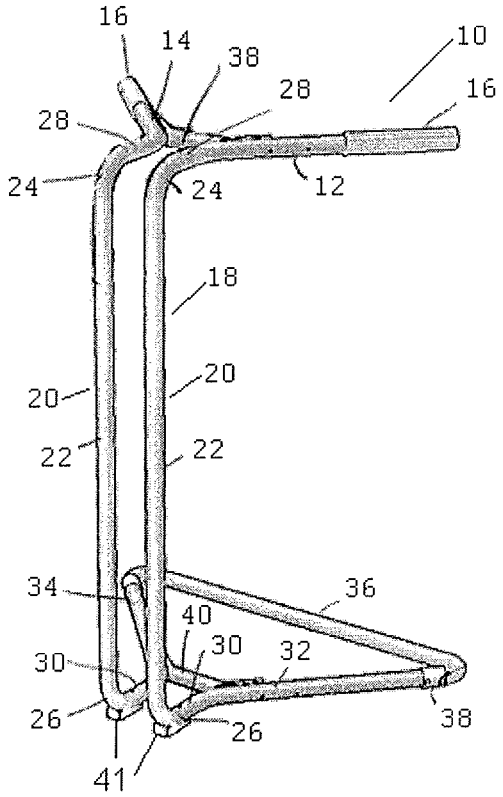
FIG. 1A shows a left perspective view of an exercise apparatus according to the first embodiment.
Figure 1B:
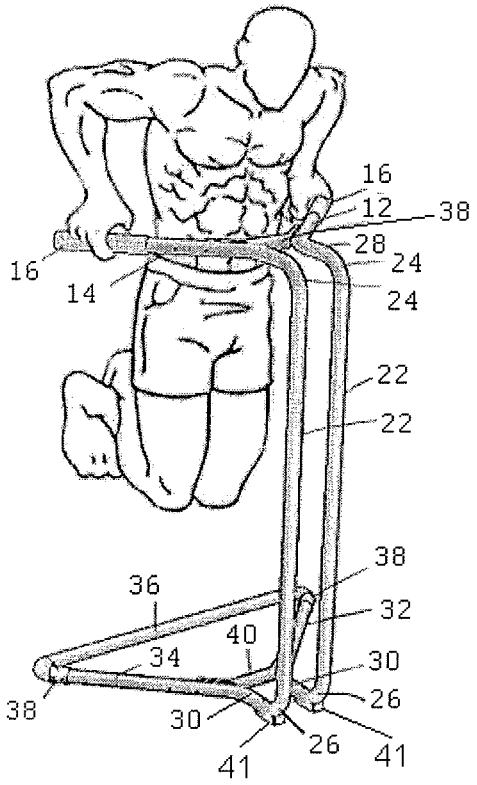
FIG. 1B shows a right perspective view of an exercise apparatus according to the first embodiment.

FIGS. 1A and 1B show perspective left and right views of an exercise apparatus 10 according to the first embodiment of the present invention.

Apparatus 10 includes two support bars 12, (dip bars), which may be elongated steel tubes or the like. Support bars 12, 14 are arranged on the same plane in a non-parallel orientation. Preferably, support bars 12, 14 are oriented at a 90° angle relative to one another. Each support bar 12, 14 may be provided with a grip 16 at its free end. Each grip 16 extends over at least part of a support bar 12,14 with which it is associated.

Dip bar apparatus 10 further includes a stand portion 18. Stand portion 18 includes two spaced, and preferably tubular, supports 20 each integrated with a respective support bar 12, 14 at a respective top end thereof.

Each vertical support 20 preferably includes an elongated, vertical portion 22 (i.e. vertical relative to the ground when apparatus 10 is positioned for dip exercises), a top bend portion 24, a bottom bend portion 26, a horizontal top portion 28 (horizontal relative to the ground when apparatus 10 is positioned for dip exercises), and a horizontal bottom portion 30 (horizontal relative to the ground when apparatus 10 is positioned for dip exercises).

Each top bend portion 24 resides between and connects a vertical portion 22 and a respective horizontal top portion 28. Each horizontal top portion 28 includes a respective top end of a support 20, which is connected with a respective support bar 12,14.

Each bottom bend portion 26 resides between and connects a vertical portion 22 and a respective horizontal bottom portion 30. Horizontal top portions 28 and horizontal bottom portions 30 are preferably oriented parallel to one another and transverse to the direction of elongation of vertical portions 22.

Stand portion 18 further includes a first base support 32, and a second base support 34 arranged on the same plane and extending preferably in a non-parallel direction relative to one another (e.g. at a 90° angle relative to one another). Each base support 32, 34 may be connected at one end to a respective horizontal bottom portion 30 and at an opposite end to a respective end of a base tie bar 36, preferably with a releasable coupling 38. First base support 32 and second base support 34 may be oriented along a plane parallel to the plane along which support bars 12,14 reside.

In the preferred embodiment, support bars 12, 14, top bend portions 24, bottom bend portions 26, vertical portions 22, top horizontal portions 24, bottom horizontal portions 30, base supports 32, 34 and base tie bar 36 are integrated to realize a continuous body extending continuously from one free end of one support bar 12 to another free end of the other support bar 14.

Moreover, while base tie bar 36 may be quickly disconnected (which may allow the apparatus to be disassembled for storage), in the preferred embodiment, each support bar 12, 14 and its associated top horizontal portion 28, top bend portion 24, vertical portion 22, bottom bend portion 26, bottom horizontal portion 30 and base support 32, 34 may be integrated into a unitary body by, for example, bending a steel tube or the like to realize the various portions disclosed herein or by welding a plurality of tubes to realize a unitary body that includes the various portions described herein.

To prevent support bars 12, 14 from spreading away from one another when apparatus 10 is in use, a top tie bar 38 may be coupled (preferably with a releasable coupling) between and to support bars 12, 14 and a bottom tie bar 40 may be coupled (preferably with a releasable coupling) between and to base supports 32, 34. Screws or the like fasteners may be used to couple the top and bottom tie bars 38,40.

In addition, rubber feet 41 may be attached to bottom bend portions 26 for additional support.

Figure 2:
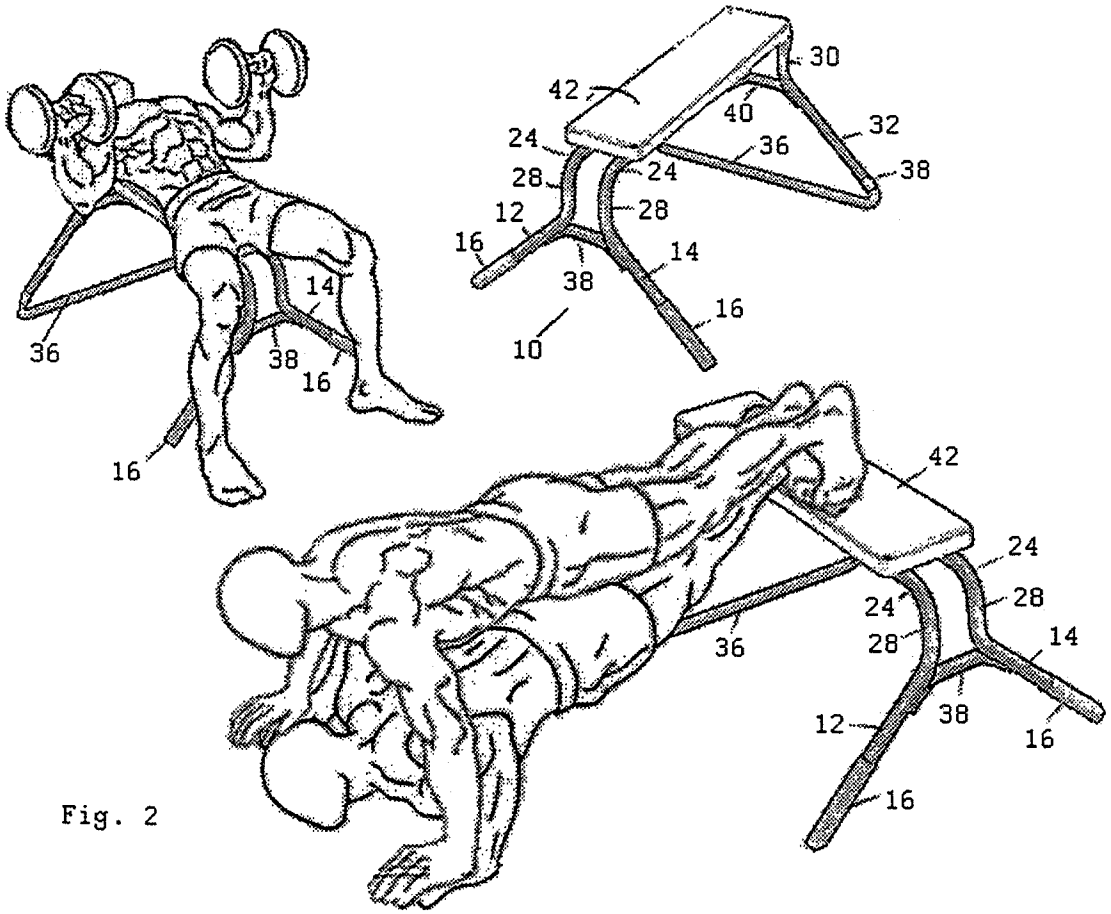
FIG. 2 illustrates an exercise apparatus according to the first embodiment repositioned to serve as a bench support.

Referring to FIG. 2, an apparatus 10 may be supported on the ground at the ends of support bars 12, 14 and on base tie bar 36. A back support 42 may be coupled (e.g. with snaps or the like for easy disassembly) to vertical supports 22, whereby apparatus 10 may be used as an exercise bench. Thus, apparatus 10 can be a support for a bench as well as an exercise apparatus for performing dip exercises.

Figure 3A:
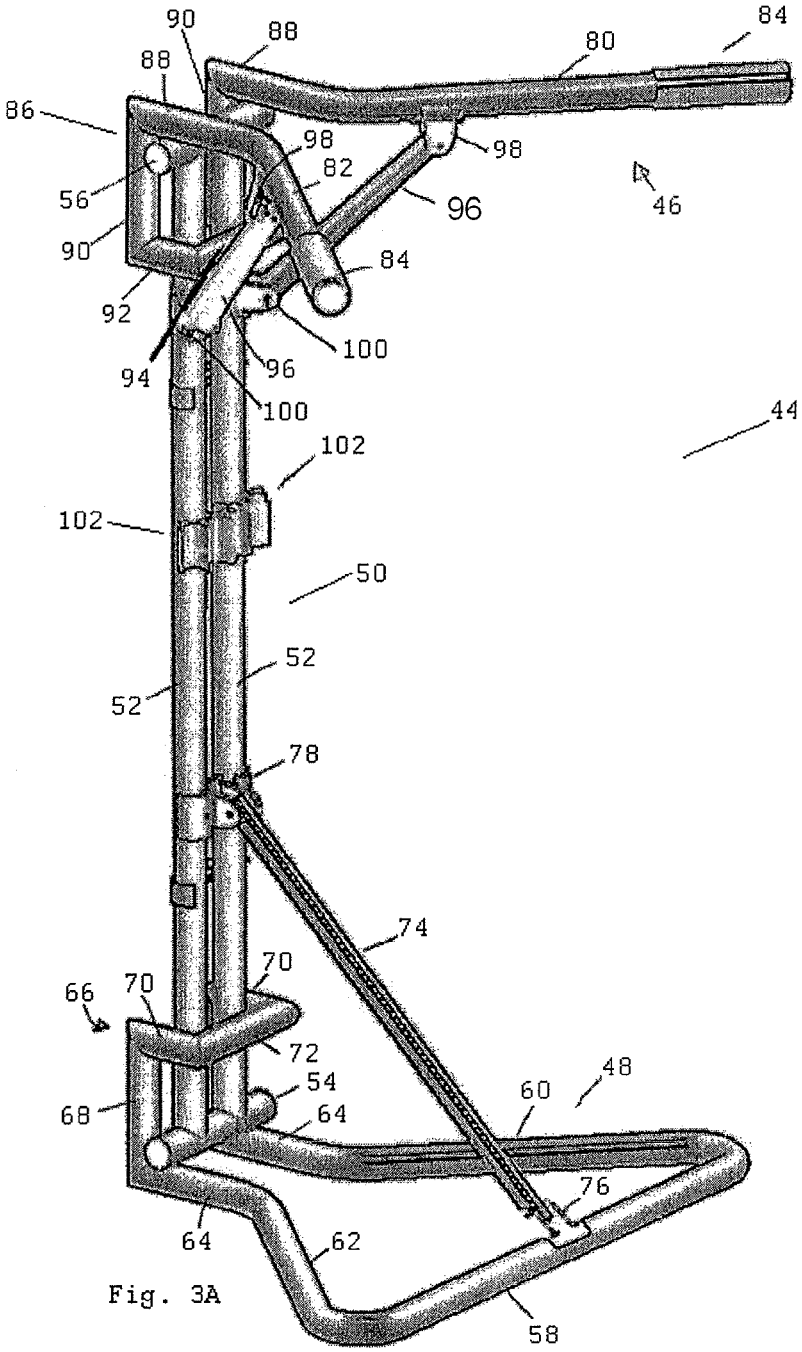
FIG. 3A shows a left perspective view of an exercise apparatus according to a second embodiment of the present invention in an assembled state.

Referring now to FIG. 3A, an exercise apparatus 44 according to the second embodiment of the present invention includes a dip bar section 46, a base section 48 and a vertical stand 50 (vertical relative to the ground when apparatus 44 is positioned for dip exercises).

Stand 50 is vertically supported on base section 48 at one end thereof and supports dip bar section 46 at another opposing end thereof.

Vertical stand 50 includes two spaced, parallel, elongated tubes 52 each integrated by welding or the like at one end thereof to a bottom tie tube 54 and at an opposite end to a top tie tube 56. Top and bottom tie tubes 54, 56 are preferably oriented at a 90° angle relative to elongated tubes 52 and are parallel to one another.

Base Section 48 is preferably a unitary endless tube (fabricated, for example, by welding a plurality of tubes) that includes a base tie tube 58 connected at each end to respective ends of two spaced base support tubes 60, 62. Two parallel, horizontally oriented (horizontal relative to the ground when apparatus 44 is positioned for dip exercises) rest tubes 64 are connected to respective ends of base support tubes 60, 62. As illustrated, in an assembled state, bottom tie tube 54 rests on rest tubes 64.

Rest tubes 64 are connected to one another by a base coupling tube 66. Base coupling tube 66 includes two spaced, parallel spacer tubes 68, which extend at 90° away from rest tubes 64, two horizontally oriented portions 70, which extend parallel to one another, and parallel to rest tubes 64 toward base tie tube 58 in the same direction as tubes 64, and a tie tube 72 that is connected between and to horizontally oriented portions 70 and extends in a direction transverse to rest tubes 64.

As illustrated, in an assembled state, portions 70 and tie tube 72 serve as a receptacle/cradle that receives elongated tubes 52 interiorly thereof, allowing elongated tubes 52 to rest against portions 70 and tie tube 72 while bottom tie tube 54 rests against vertical portions 68 and rest tubes 64, whereby rotation of stand 50 toward base section 48 may be prevented.

To further hinder the rotation of stand 50 toward and away from base section 48 an elongated fold bar 74 is coupled at one end to a bracket 76 residing on base tie tube 58 with a removable pin or the like to facilitate disassembly, and, at an opposite end, pivotally mounted to a bracket 78 which resides on and is connected to vertical tubes 52.

Dip bar section 46 includes a first dip bar tube 80 and a second dip bar tube 82 each having a free end. A grip 84 is preferably assembled at each free end of each dip bar tube 80, 82 and extends partially thereover. Two parallel, horizontally oriented (horizontal relative to the ground when apparatus 44 is positioned for dip exercises) top rest tubes 88 are connected to respective ends of first and second dip bar tubes 80, 82. As illustrated, in an assembled state, top tie tube 56 resides below and supports top rest tubes 88.

Top rest tubes 88 are connected to one another by a dip bar coupling tube 86, which has preferably the same general configuration as base coupling tube 66. In the preferred embodiment, first and second dip bar tubes 80,82, top rest tubes 88 and dip bar coupling tube 86 form a continuous, unitary body that can be realize either by bending a tube into a shape that would include the aforementioned tubular sections of the dip bar section 46 as described and illustrated, or by welding a plurality of tubes to realize a dip bar section 46 as described and illustrated.

Dip bar coupling tube 86, which in an assembled state rest on top tie tube 56, includes two spaced and parallel, spacer tubes 90 each extending from a respective rest tube 88 at a 90° angle, two horizontally oriented and parallel tubes 92 each extending at a 90° angle away from a respective spacer tube 90 in the direction of, and parallel to, rest tubes 88 and a tie tube 94, which is connected to and between parallel tubes 92. As illustrated, tubes 92 and tie tube 94 together serve as a receptacle/cradle that receives elongated tubes 52 interiorly thereof.

In an assembled state, top tie tube 56 resides below and supports rest tubes 88, tie tube 94 rests against elongated tubes 52, and top tie tube 56 rests against spacer tubes 90, whereby rotation of dip bar section 46 about the longitudinal axis of tie tube 56 and toward base section 48 may be hindered.

To further hinder the rotation of dip bar section 46 toward and away from base section 48 a fold bar 96 is coupled at one end (with an easily removable pin or some other easily releasable coupling) to a bracket 98 residing on a dip bar tube 80, 82, and at another, opposite end pivotally coupled to a bracket 100 residing on a respective elongated tube 52.

Preferably, snap-fit couplings 102 are arranged on elongated tubes 52 each for snap-fit reception of a respective fold bar 96, 74 when apparatus 44 is in a disassembled state.

Figure 3C:
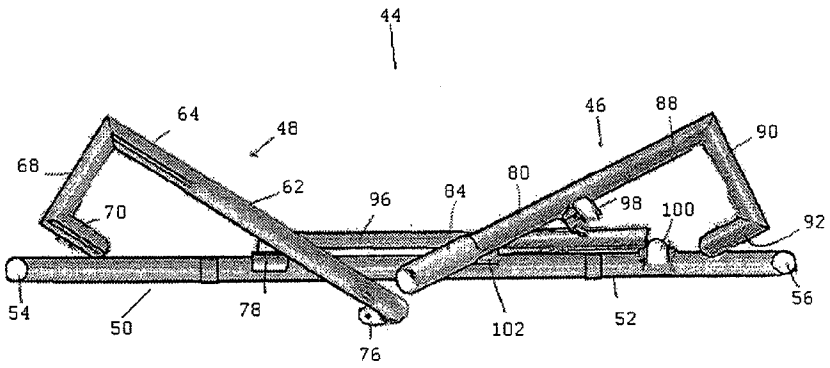
FIG. 3C shows an exercise apparatus according to the second embodiment in a disassembled state.
Figure 3B:
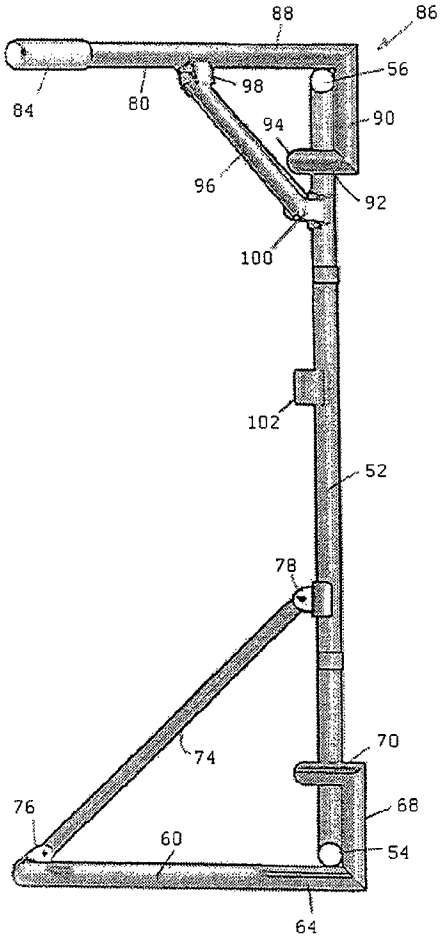
FIG. 3B shows a right plan view of an exercise apparatus according to the second embodiment in an assembled state.

FIG. 3C illustrates a side plan view of apparatus 44 in a disassembled state. Thus, to disassemble apparatus 44, bar 74 is disengaged from bracket 76 and pivotally rotated about a pivot pin associated with bracket 78 and snapped onto a snap-fit coupling 102 provided on tubes 52. Once bar 74 is disengaged from base section 48, base section 48 may be disassembled from stand section 50.

To disassemble dip bar section 46 each fold bar 96 is disengaged from its associated bracket 98 by removing the removable pin associated with that bracket and rotated about the pivot pin associated with its bracket 100 until it is received in a snap-fit coupling 102.

Figure 3D:
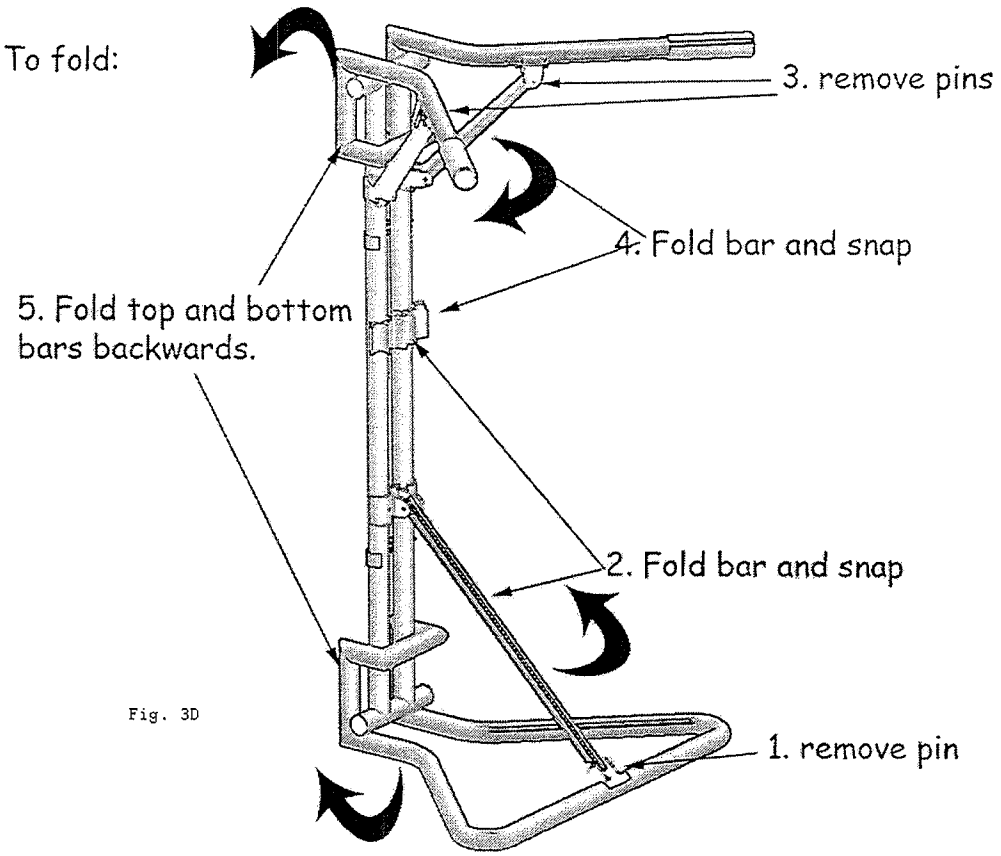
FIG. 3D visually illustrates a procedure for the disassembly of an exercise apparatus according to the second embodiment.

Once bars 96 are disengaged, dip bar section 46 may be disassembled from stand section 50. FIG. 3D visually illustrates the disassembly procedure as described here.

In an apparatus 44, dip bar section 46 and base section 48 may be rotatably coupled to stand section 50 and rotatably folded when bars 74 and 96 are disengaged.

In an alternative configuration, dip bar section 46, base section 48 and stand section 50 may be independent pieces (not integrated).

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An exercise apparatus, comprising: a self-supporting stand supporting a plurality of dip bars arranged on a first common plane and oriented along non-parallel directions relative to one another, said self-supporting stand being elongated and supported on a base section, said self-supporting stand comprising a plurality of spaced elongated supports and supporting a dip bar section that comprises said dip bars, and is supported on the base section, the base section comprising a plurality of base supports, said dip bar section being disengageably engageable with said elongated supports and said base section being disengageably engageable with said elongated supports;

a first tie member connecting first ends of said elongated supports, and a second tie member connecting second ends of said elongated supports, wherein said first tie member rests on said base section and said second tie member supports said dip bar section, wherein said dip bar section includes a dip bar section cradle that receives said elongated supports, and said base section includes a base section cradle that receives said elongated supports, and wherein said base section is rotatable about said first tie member in a first direction to disengage from said elongated supports, and said dip bar section is rotatable about said second tie member in a second direction opposite said first direction to disengage from said elongated supports.

2. The exercise apparatus of claim 1, wherein said base section cradle comprises a portion that abuts said elongated supports when said base section is rotated in said first direction and said dip bar section cradle comprises a portion that abuts the elongated supports when said dip bar section is rotated in said second direction.

3. The exercise apparatus of claim 2, wherein said base section comprises a base tie member connecting said base supports, and further comprising a first elongated fold bar disengageably connected at one end to said base tie member and pivotably connected at another opposite end to said elongated supports.

4. The exercise apparatus of claim 3, further comprising a second fold bar disengageably connected at one end to one of said dip bars and pivotably connected at another end to one of said elongated supports, and a third fold bar disengageably connected at one end to another one of said dip bars and pivotably connected at another end to another one of said elongated supports.

5. The exercise apparatus of claim 4, further comprising a snap fit connector residing on the elongated supports for snap fit reception of said fold bars.

6. The exercise apparatus of claim 2, wherein said elongated supports are parallel to one another.

7. The exercise apparatus of claim 2, wherein said first direction is clockwise and said second direction is counter clockwise.

8. The exercise apparatus of claim 1, wherein said base section comprises a base tie member connecting said base supports, and further comprising a first elongated fold bar connected at one end to said base tie member and at another opposite end to said elongated supports.

9. The exercise apparatus of claim 8, further comprising a second fold bar connected at one end to one of said dip bars and connected at another end to one of said elongated supports, and a third fold bar connected at one end to another one of said dip bars and at another end to another one of said elongated supports.

10. The exercise apparatus of claim 1, wherein said base supports are arranged on a second common plane parallel to said first common plane and said self-supporting stand is oriented vertically relative to said first common plane when said first common plane is oriented horizontally, the first and the second planes extending away from said self-supporting stand in a same direction.

* * * * *